US005289837A

United States Patent [19]

Betancourt

[11] Patent Number: 5,289,837

[45] Date of Patent: Mar. 1, 1994

[54] ENGINE CLEANING SYSTEM

[76] Inventor: Eduardo Betancourt, 1354 N. Ferndale St., Anaheim, Calif. 92108

[21] Appl. No.: 987,597

[22] Filed: Dec. 9, 1992

[51] Int. Cl.[5] ..... B08B 3/04; B08B 9/00

[52] U.S. Cl. ..... 134/57 R; 134/111; 134/113; 134/169 A

[58] Field of Search ..... 134/169 R, 169 A, 57 R, 134/100.1, 111, 113; 123/198 A

[56] References Cited

U.S. PATENT DOCUMENTS

| | | | |
|---|---|---|---|
| 2,665,772 | 1/1954 | Greer et al. | 134/169 A X |
| 3,593,729 | 7/1971 | Goldware | 134/113 X |
| 4,784,170 | 11/1988 | Romanelli et al. | 134/169 A X |
| 4,787,348 | 11/1988 | Taylor | 134/169 A X |
| 4,877,043 | 10/1989 | Carmichael et al. | 134/169 A X |
| 4,909,207 | 3/1990 | Takano et al. | 123/198 A |
| 4,991,608 | 2/1991 | Schweiger | 134/169 A X |
| 5,015,301 | 5/1991 | Baylor et al. | 134/169 A X |

*Primary Examiner*—Philip R. Coe
*Attorney, Agent, or Firm*—Ralph S. Branscomb

[57] ABSTRACT

An internal combustion engine purging system cleans out deposits of carbon and other substances that accumulate over time in the fuel system by delivering a mixture of fuel and cleaning solution into the fuel intake ports while the engine is running, so that the engine pulls the mixture through the carburetor jets or injectors. This purging system is characterized by its virtual universal application with substantially any commercially produced gasoline or diesel engine. It is in part comprised of two separate but overlapping systems, one for gasoline and one for diesel, which are selectable by the operator. Engines as small as a lawnmower and as large as a locomotive diesel can be purged by the system due to a combination of a high-capacity diesel pump motor which can deliver two gallons of fuel per minute at a pressure of 50 pounds per square inch, and a flow control system which can meet the needs of substantially any engine in terms of the flow rate and pressure of the fuel that it requires for its fuel intake, and a separate gasoline pump.

13 Claims, 2 Drawing Sheets

QUICK CONNECT COUPLER
LOW PRESS. SWITCH
FLOWMETER
PRESS. REG
PRESS. REG.
RELIEF
RELIEF
CH
VENT
VENT
DIESEL/SOLV. MIX
DIFFERENTIAL VAC. SW.
GAS/SOLV. MIX
FILTER
M
P
P
M

ENGINE CLEANING SYSTEM

BACKGROUND OF THE INVENTION

The purging or scrubbing of the fuel intake passageways of internal combustion engines by means of introducing fuel mixed with solvent into the fuel intake is not new. It has been appreciated for years that this technique avoids the expensive proposition of dismantling the engine to clean carburetor jets or injectors. Due to the nature of the internal combustion engine, it is inevitable that after a period of time the engine will build up deposits that impede its performance.

Prior art devices have been developed, and until recently have been used by the instant inventor in his own business until he developed the improved purging system that is the subject of this disclosure. It is a principle improvement of the invention that it incorporates both gasoline purging and diesel purging in the same machine, with common portions of the gasoline and diesel systems overlapping. However, there are other features that distinguish the invention from the prior art, and make it possible to provide purging service of such a wide variety of commercially produced internal combustion engines.

Systems that function in the same general manner are disclosed in a number of U.S. patents which will be described below.

U.S. Pat. No. 4,520,773 issued on Jun. 4, 1985 discloses an injection cleaning and testing system which introduces a fuel-cleaning solvent mixture into the engine fuel intake. However, this system is for a single fuel only. It has no fuel mixture return line and utilizes a fuel relief line that does not communicate with the fuel tank, but rather is connected to the pump vacuum line. This is considered a handicap for use with high-volume diesel engines. Although the same system could be used with gasoline or diesel mixtures, because diesel engines, especially large diesels, are substantially different in their fuel intake requirements from gasoline engines, aside from the inconvenience of switching fuels, there is also the problem of not providing cleaning capabilities for the wide range of engines that is possible with the two-in-one system of the instant inventor.

U.S. Pat. No. 4,787,348, issued Nov. 29, 1988 is designed exclusively for the use of diesel engines. Although it uses a mixture tank and a storage tank, both tanks hold the same mixture. This system has no regulator at all, relying on a pre-set relief valve to control fuel delivery pressure.

U.S. Pat. No. 4,877,043, issued Oct. 31, 1989 is stated as being useful for gasoline, small diesel, or methane burning internal combustion engines. It is a single system rather than a dual system, and for this reason is believed to be considerably more limited in its application than the disclosure would lead one to believe. The small size of the pump's fuel ports, hoses, regulators and the overall system design would make it unlikely that this machine could be used on large diesels.

U.S. Pat. No. 4,989,561, issued Feb. 5, 1991 is designed for carbureted and EFI engines and injects the fuel-solvent mixture into the air intake only, rather than the fuel supply line. It is not designed to work with diesel engines or high-pressure injected gasoline systems. It does not clean the fuel passageways and fuel sprayers inside a carburetor, or the fuel rail, fuel regulator or injectors of an injected system, which is the main thrust of the other devices described. It will not work with continuous injection systems (C.I.S.)

U.S Pat. No. 5,063,896, issued Nov. 12, 1991 is actually made to clean the transmission or the oil system of an engine rather than its fuel system.

The number of recent patents falling within this general subject matter area indicates the interest in internal combustion engine purging that has developed in recent years. This is likely because of the relatively recent surging of fuel injected gasoline engines into mainstream car manufacturing.

Despite this display of interest however, there is still a need for a universally applicable purging system effective not only for both gasoline and diesel engines, but also having the true capability of meeting the requirements of very large high-fuel-flow/-volume diesels, but small gasoline engines as well.

SUMMARY OF THE INVENTION

The instant invention fulfills the above stated need and comprises two basic, overlapping systems, one of which is designed for gasoline engines and the other for diesels. Although the systems have certain subsystems in common and output to a single set of supply and return ports, the separation of the two functions goes beyond the mere elimination of the nuisance of draining one fuel and replacing it with another when switching between engine types.

The system accommodates the wide range of commercially available engines by utilizing a different pump and a different supply and return system for the diesel side and for the gas side. The diesel side has a high-volume pump, and the in-line control and indicator units on the diesel side are all provided with valve bypasses except for the pump and the in-line filter, so that they can be removed from the diesel side supply line to eliminate their flow restriction when servicing high-volume diesels.

Whereas the diesel side of the system is tailored toward high volume, it is also quite effective when servicing smaller diesels. However, it is somewhat too rough and lacks the fine-tuning capability in terms of flow and pressure that is appropriate for gasoline engines. Thus the gasoline side of the system is specific to the needs of gasoline engines only, having a pump that will produce a flow of about 200 cubic centimeters per minute, versus the 2 gallons per minute flow that is possible from the diesel side.

Because the system is powered by the battery of the engine that it services, both 24 volt and 12 volt power inputs are accepted by the system, which houses a voltage divider that reduces the 24 volts to 12 volts for operating the entirely 12-volt system.

DETAILED DESCRIPTION OF THE PREFERRED EMBODIMENT

Figure 1:
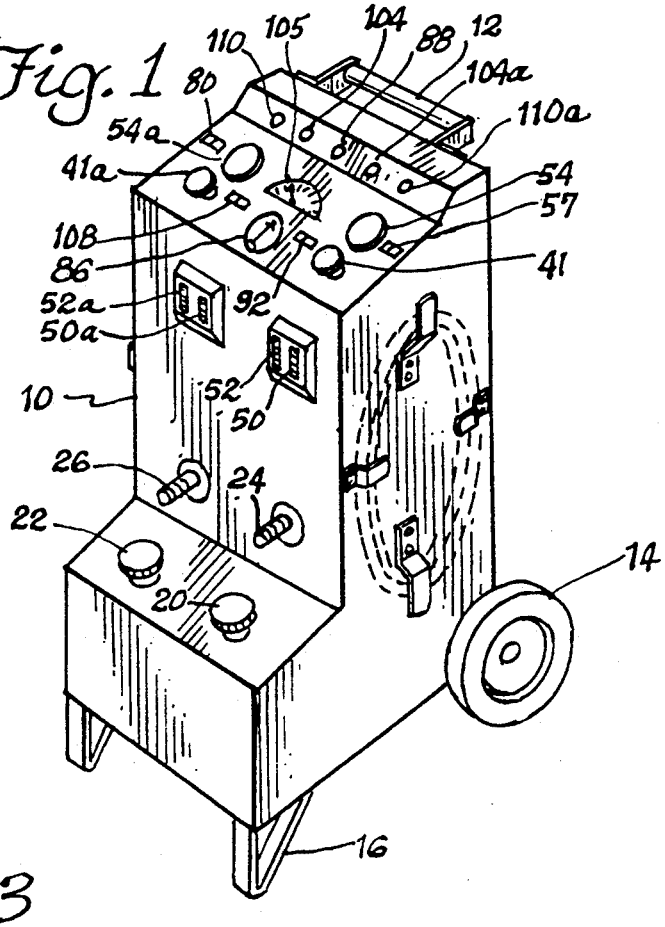
FIG. 1 is a perspective view of the system in its housing.

The external configuration of the finished system is shown in FIG. 1. A sheet metal housing 10 mounts a handle 12, a pair of wheels 14 and front leg braces 16. A hose rack 18 is mounted on one side, and the gas and diesel mixture tanks have filling ports, the caps of which can be seen at 20 and 22, respectively. Two quick-connect couplings for the common main supply and main return lines are indicated at 24 and 26, respectively.

Other features of the invention which interface with the outside world through the housing will be identified below in the functional description of the system.

Figure 2:
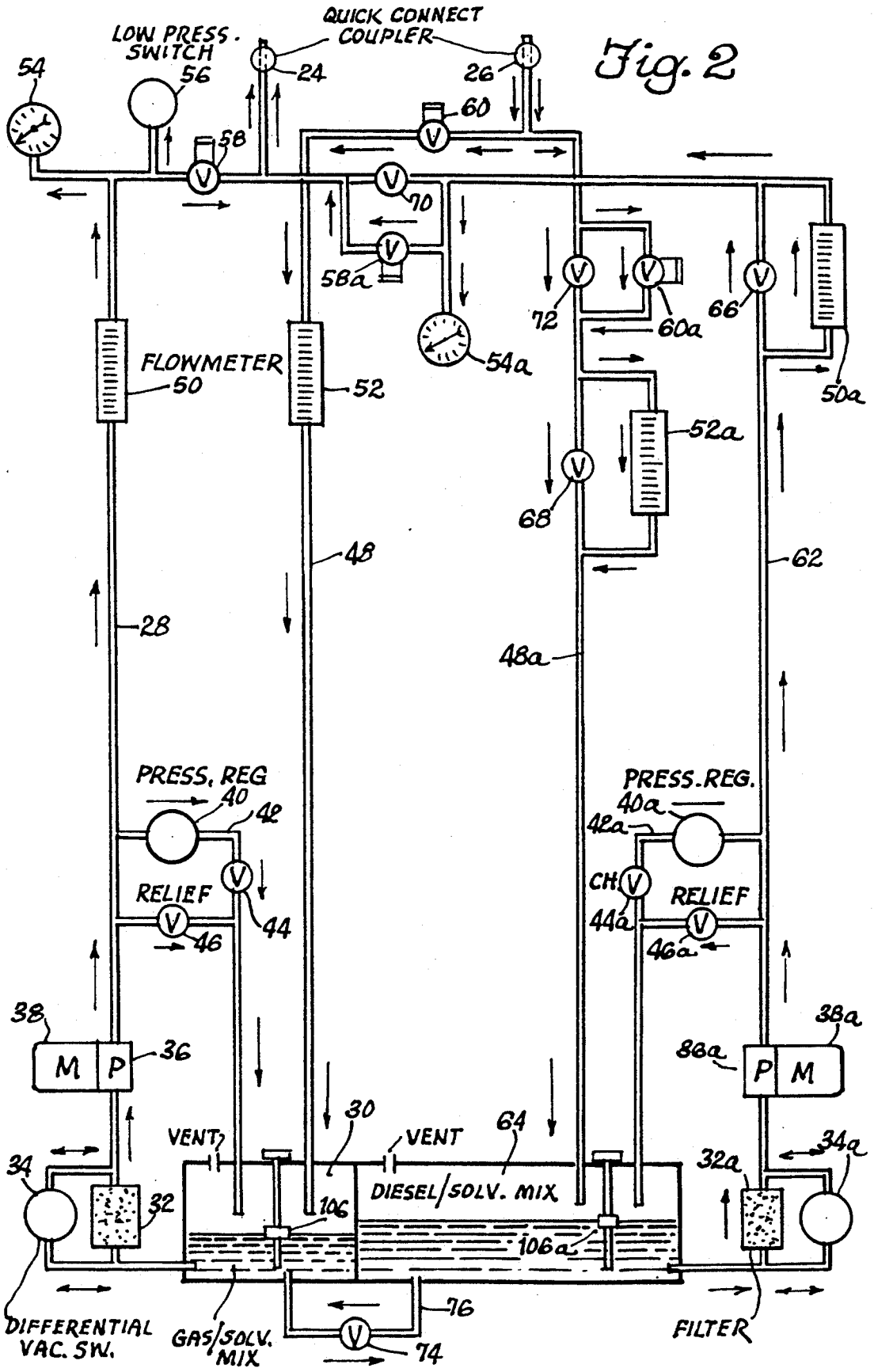
FIG. 2 is a schematic diagram of the fuel flow lines.

Turning to the fuel flow diagram of FIG. 2, the system as described and claimed has a main supply and a main return line, with both of these main lines being substantially comprised of the separate gas and diesel supply and return line. However, both supply lines output to the main supply line quick-connect coupling 24, and both of the separate return lines connect to the main return line coupling 26. The system connects to any engine through the same two quick-connect couplings, with different hoses and adapters being used to accommodate different engine fittings.

The gasoline side will be described first. The gasoline supply line 28 receives fuel from the gas tank (hereinafter, in the specification and claims, "gas" will be understood to mean "gasoline") 30. The gas and diesel tanks are listed as separate elements in the claims, but could be divisions of a single tank as shown in the drawings and the claims should be interpreted to cover this configuration. The gasoline is passed through an in-line filter 32 which is straddled by the connections of a differential vacuum switch 34 which actuates a clogged filter condition indicator when the pressure drop across the filter exceeds a predetermined level.

The gasoline tank actually holds a mixture of gasoline and a solvent. It is pumped up through the pump 36 by the motor 38. The motor operates on 12 volts, and the pump has a capacity of about 200 cc/min. at a pressure of 95 pounds per square inch. The pressure regulator 40 is installed in a return loop 42 which includes a check valve 44 and a relief valve 46 which is pre-set to open just below the maximum operating pressure of the pump 36 so that in case of pressure regulator failure or line blockage the motor and pump are not damaged.

The pressure regulator is adjustable substantially over the entire range of pressures from almost none to the maximum capability of the motor-pump combination. It is adjusted by rotation of the knob 41, shown in FIG. 1. Once the correct pressure is established for the particular engine being purged, the flow of mixture is determined by the engine itself. The excess fuel gas return line 48 returns any unused fuel to the mixture tank. In-line supply and return flow meters 50 and 52 are displayed on the front of the housing as seen in FIG. 1, as is the delivery pressure gauge 54.

The low pressure switch 56 de-energizes the pump motor and flow meters and actuates a buzzer should the pressure in the gas supply line fall below a pre-set minimum. A momentary switch 57 bypasses the switch 56 to allow the unit to start. Solenoid valves 58 and 60 operate in conjunction with two similarly situated valves, described below, on the diesel side, to connect or disconnect the supply and return outlets to the gasoline side.

The diesel side of the system is very similar to the gasoline side, and similar parts are identified by the same number as the gasoline side part with an "a" extension.

The diesel supply line 62 similarly utilizes a diesel and solvent mixture tank 64, a filter **32*a*, vacuum switch 34*a*, pump 36*a*, motor 38*a*, regulator 40*a*, regulator adjustment knob 41*a*, return loop 42*a*, check valve 44*a*, relief valve 46*a* and diesel delivery pressure gauge 54*a*. The diesel return line 48*a* returns unused fuel to the diesel tank, and supply and return flow meters 50*a* and 52*a* are inserted in-line, except that they have bypass valves 66 and 68** which are actually more in-line than the flow meters, as their purpose is to eliminate flow resistance from the flow meters when dealing with very high fuel flow requirements of locomotives and large marine engines and the like.

Supply and return solenoid valves **58*a* and 60*a*, respectively, are similarly bypassed with valves 70 and 72. These solenoid valves are bypassed because even when opened they provide some resistance to fluid flow. Somewhat obviously, the gasoline line solenoids 58 and 60 always operate in reverse from the diesel solenoids 58*a* and 60*a*** to determine which side of the system is to be used.

Bypass valves 66, 68, 70 and 62 are manual valves accessible from the rear of the housing, not shown. Because these valves are only used when servicing very large diesel engines, and presumably for most system operators this would not occur too often, accessibility from the front or top of the housing for convenience is not necessary. A fifth manual valve 74, also within the housing, connects the gas and diesel tanks through the connector line 76 so that in the event that it is desirable to use the capacity of both tanks with a single fuel type, this can be achieved.

Turning now to the control and indicator systems, as well as the power supply system and circuitry, reference will be made principly to FIG. 3. It can be seen in this figure that power inputs 78, of plus and minus DC voltage, can be either 24 volts or 12 volts, corresponding to the voltages normally used by internal combustion engines. Large diesels use 24 volts.

In the event 24 volts is input to the system, the input power switch 80 directs the input first to a rectifier or voltage divider 82 to reduce it to 12 volts before passing it through to the system.

The positive side of the power input delivers power to the system first through the timer or switch 84. The timer 86 which operates this switch is preferably a rotating-knob, analog type as as indicated at 86 in FIG. 1.

Figure 3:
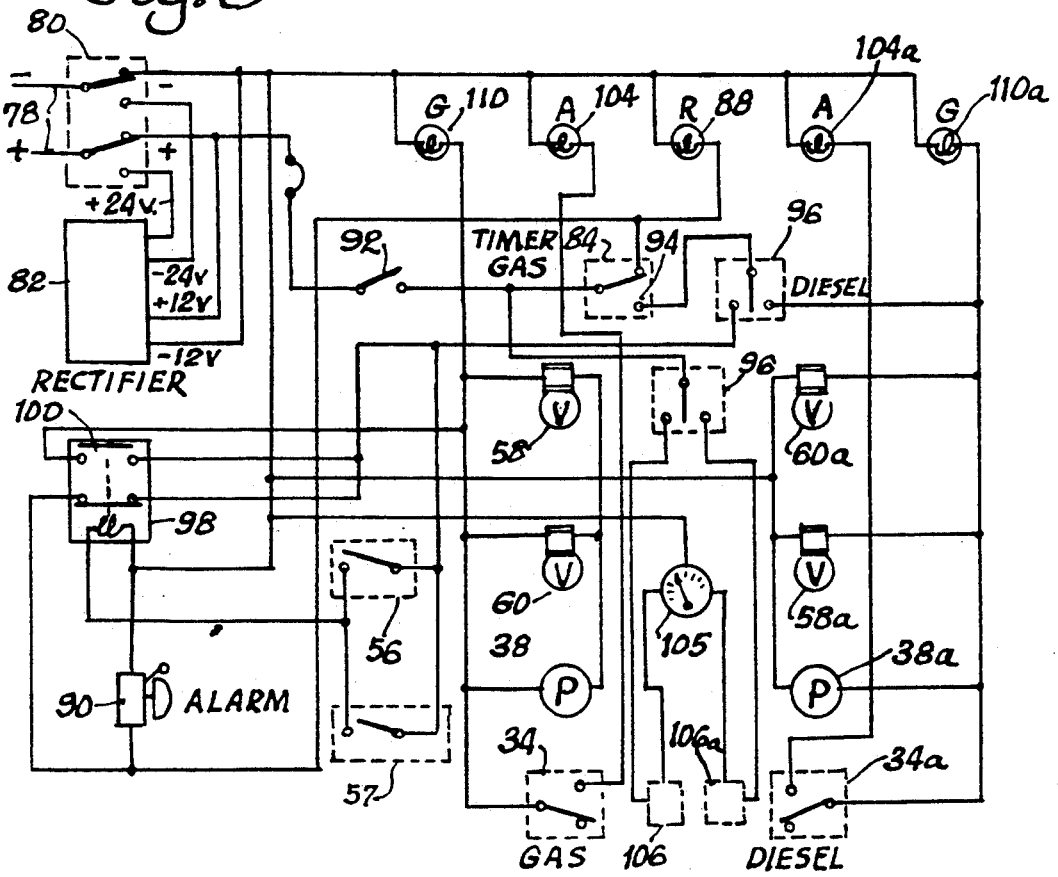
FIG. 3 is an electrical schematic of the control, power and indicator systems of the purging system.

It can be seen in FIG. 3 that the timer switch, which is normally in the up position, corresponding to the timer having run out or not having been set, illuminates the red light indicator 88 and actuates the alarm or buzzer 90 indicating that the time set on the machine has expired. This prompts the operator to either shut the machine off with on/off switch 92 or start it up again.

When the timer is set, input positive power is delivered to the timer switch output 94, or it connects to the distribution switch 96. This switch has a central, "OFF" position, a gas side position indicated by the switch arm rotating to the left in FIG. 3, and a diesel position.

When the distribution switch actuates the gasoline side, it operates the relay 98, provided the low pressure switch 56 is not open due to a low pressure condition. Because the low pressure switch is always open when the system is off, a bypass switch 57 is necessary to for starting. The relay 98 is simultaneously connected to +12 V which it distributes to the upper, normally-open contact 100 rather than to the lower, normally closed contact. The normally closed contact is only effective when the low pressure switch 56 is open, in which instance it powers the alarm 90 since the alarm is no longer powered through the timer switch.

The +12 V distributed through the relay powers the pump motor 38 and the two solenoids 58 and 60. In addition, it provides a +12 V to the vacuum differential switch 34, which has its own amber-colored clogged filter indicator light 104. The fuel mixture level indicator 105, seen in FIG. 1, receives input from one of the level sensors 106 or 106*a* depending on the setting of the level sensor selector switch 108. The selector switch provides power alternatively to the selected sensor 106 or 106*a*, so that is the sensor that outputs a signal to the level gauge.

The remaining indicator light 110 on the gas side automatically illuminates whenever the gas side is energized.

The diesel side of the system, when selected by the switch 96, is virtually identical to the gas side except that it does not have a relay 98, low-pressure switch 56, or circuitry actuating the alarm 90 in the event of low pressure. +12 V is applied to the left side of the pump motor 38*a*, and the two solenoids 58*a* and 60*a*. The vacuum differential switch 34*a* illuminates its own diesel filter clog indicator 104*a* in the event of filter clog, and a green "ON" light G provides a visual indication that the diesel side of the system is in operation.

In operation, the system is used in general as follows. First, the appropriate hoses and adapters are used to match the engine being serviced. They are connected to the supply and return couplings 24 and 26, and the power input of the system is connected through cables and spring clamps, not shown, to the engine battery. The appropriate settings are made to select the diesel or gas side, set the respective pressure regulator by turning the appropriate knob on the front panel of the console, and then set the timer for the desired duration of the purge.

The engine is then started and run at idle for ten to fifteen minutes. It is subsequently accelerated to about 2500 rpm for 5 to 7 seconds, and then the throttle is released. As soon as the engine returns to idle, the throttle is opened fully until it reaches 3000 to 3500 rpm, and then let returned to idle, with this cycle being repeated four or five times.

The engine is then turned off to let it soak in the cleaning solution and fuel for ten or fifteen minutes, and then the cycling between idle and 3000 rpm is repeated.

The engine is returned to idle for a period of ten or fifteen minutes, being accelerated occasionally to 2,500–3,500 rpm. The overall duration of the purging should be about half an hour.

The connector hoses are then disconnected from the engine, with the engine's own fuel lines being re-connected, and the engine is started and checked for leaks.

This sequence is representative, as different sequences would be used by different operators and for different engines.

Because the unit is effective at purging such a wide range of commercially available engines, no doubt in some situations with certain engines a specific sequence other than that set forth above would be used. In any event, the system as illustrated, described and claimed is truly a universal unit, making it conveniently possible to purge almost any commercially produced internal combustion engine from a small lawnmower engine to very large locomotive or marine engine consuming three gallons of fuel per hour at idle and two gallons of fuel per minute at full open throttle. While not utilizing complex circuitry or expensive control systems, the system nonetheless has incorporated virtually every conceivable feature that is needed to accomplish the universal purging servicing that has been described.

It is hereby claimed:

1. A purging system for purging internal combustion engines by temporarily replacing the engine's fuel supply system with an external source of fuel and solvent mixture, comprising:

(a) first and second fuel and solvent mixture tanks (b) a main supply line for delivering fuel to said engine;

(c) a main return line for returning unused fuel from said engine;

(d) a tank selector valve system interposed in said supply and return line for selectively connecting either said first or second tank to both of said lies; and, (e) pump means for delivering mixture from a selected one of said tanks through said supply line to power and clean an engine connected thereto; and, (d) said tanks are designated as a gas tank and a diesel tank, respectively, and said main supply line includes a gas and a diesel supply line specific to the respective mixture tank, and said main return line includes a gas and a diesel return line specific to the respective mixture tank and having control and indicator systems specific to the different flow and pressure requirements installed in the respective gas and diesel line.

2. A system according to claim 1 wherein said puring system accommodates substantially the entire range of commercially available gasoline and diesel engine fuel flow and pressure requirements, and said gas and diesel supply lines have separate in-line pumps specific to the pressure and flow requirements of the range of commercially available gas and diesel engines, respectively, accommodated by said purging system.

3. A system according to claim 1 wherein said gas pump has a fuel flow and pressure capability of at least on the order of 150 cubic centimeters per minute at 95 PSI, and said diesel pump has a maximum fuel flow and pressure delivery capability on the order of two gallons per minute at 50 PSI.

4. A system according to claim 1 wherein said diesel supply and return lines have in-line control and indicator means including a pump and filter in said diesel supply line, and all of said control and indicator means except said pump and filter have valved bypasses to permit maximum fuel flow for large diesel engines.

5. A system according to claim 4 wherein one of said indicator means in one of said diesel lines comprises a flow meter.

6. A system according to claim 4 wherein each of said gas and diesel supply lines has an in-line pump and a mixture return loop connected to said supply line downstream of the respective pump and returning to the respective tank, and including a pressure regulator mounted in said return loop to avoid in-line fuel flow restriction of the pressure regulator.

7. A system according to claim 6 wherein each of said regulators has a bypass relief valve connected in parallel with the respective pressure regulator in the respective return loop.

8. A system according to claim 1 wherein said gas and diesel supply lines each has an in-line pump and pump motor and said control system includes a variable timer and a normally open timer switch closed by said timer when said timer is set, and neither of said motors is powered when said timer switch is open.

9. A system according to claim 1 wherein said gas supply line has a gas pump and a low pressure switch operatively connected thereto, said low-pressure switch being operative to actuate an indicator and cutting off power to said gas pump.

10. A system according to claim 9 wherein said control and indicator systems include separate gas and diesel electrical circuits and including a function selector switch wire in series with said timer to alternatively deliver power to said gas circuit or said diesel circuit.

11. A system according to claim 10 wherein each of said gas and diesel supply lines has an in-line filter, and each of said circuits includes a pump motor, and at least one flow meter and a pressure differential sensor/-switch connected across the filter in the respective supply line, said pressure differential sensor/switches each being operative to activate a signal in response to a pressure drop across the respective filter exceeding a pre-determined value.

12. A system according to claim 11 and including a housing enclosing and mounting substantially all of said lines, tanks, and systems and said indicator system includes tank mixture level indicators, mixture filter clog indicators, timer-off indicator and a supply line flow rate indicator.

13. A purging system for purging internal combustion engines by temporarily replacing the engines fuel supply system with an external source of fuel and solvent mixture, comprising:

(a) first and second fuel and solvent mixture tanks;
(b) a main supply line for delivering fuel to said engine;
(c) a main return line for returning unused fuel from said engine;
(d) a tank selector valve system interposed in said supply and return line for selectively connecting either said first or second tank to both of said lines;
(e) pump means for delivering mixture from a selected one of said tanks through said supply line to power and clean an engine connected thereto; and,
(f) a selectable electric power input for 12 volts and 24 volts and including a voltage dropping device for halving 24-volt power input to provide a uniform 12-volt operating voltage for the purging system independent of whether 12 volts or 24 volts was input to the system.

* * * * *